US005726390A

United States Patent [19]

Schweppe et al.

[11] Patent Number: 5,726,390

[45] Date of Patent: Mar. 10, 1998

[54] ELECTRIC BUSHING WITH VOLTAGE TAP

[75] Inventors: Friedrich Schweppe, Eppertshausen; Helmut Spaeck, Aschaffenburg, both of Germany

[73] Assignee: Siemens Aktiengesellschaft, Munich, Germany

[21] Appl. No.: 491,971

[22] PCT Filed: Jan. 14, 1994

[86] PCT No.: PCT/DE94/00035

§ 371 Date: Jul. 21, 1995

§ 102(e) Date: Jul. 21, 1995

[87] PCT Pub. No.: WO94/17535

PCT Pub. Date: Aug. 4, 1994

[30] Foreign Application Priority Data

Jan. 21, 1993 [DE] Germany ..... 9300777 U

[51] Int. Cl.[6] ..... H01B 17/00

[52] U.S. Cl. ..... 174/142; 174/152 R

[58] Field of Search ..... 174/31 R, 12 BH, 174/11 BH, 71 C, 142, 143, 152 R

[56] References Cited

U.S. PATENT DOCUMENTS

| | | | |
|---|---|---|---|
| 3,600,502 | 8/1971 | Wagenaar et al. | 174/143 |
| 4,584,429 | 4/1986 | Raketti et al. | 174/142 X |

FOREIGN PATENT DOCUMENTS

| | | |
|---|---|---|
| 0 042 788 | 12/1981 | European Pat. Off. . |
| 0 400 491 | 12/1990 | European Pat. Off. . |
| 87 04 976.7 | 7/1987 | Germany . |

*Primary Examiner*—Hyung S. Sough
*Attorney, Agent, or Firm*—Kenyon & Kenyon

[57] ABSTRACT

An electric bushing is provided with a capacitive voltage-tapping electrode having a simplified design as an insulating ring-shaped plastic body. The plastic body is coated with conductive lacquer and has supporting feet which engage on a shielding body belonging to the bushing. One of the supporting feet bears a connecting element linked to the conductive layer.

20 Claims, 4 Drawing Sheets

ELECTRIC BUSHING WITH VOLTAGE TAP

BACKGROUND OF THE INVENTION

The present invention relates generally to electric bushings, and more particularly to an electric bushing with a bushing conductor and an insulating body surrounding the bushing conductor, comprising an attachment flange anchored in the insulating body, on whose inner periphery is arranged a shielding body that controls the electric field, as well as comprising a capacitive voltage tap provided for the operation of a display device, said voltage tap being comprised of a tapping electrode that concentrically surrounds the bushing conductor inside the insulating body and of a connector element that is linked to said tapping electrode and is accessible from the outside of the insulating body.

An electric bushing of this type is described in the German utility model patent GM 87 04 976. The field-controlling shielding body having a sleeve-shaped section is designed in this case as a one-piece molded article of a rubber elastic, electrically conductive material. It is integrally cast in the insulating body and is disposed concentrically to the bushing conductor. The tapping electrode is comprised of a metallic ring, e.g. of wire connected to a supporting device, which is centered by the sleeve-shaped section of the shielding body. Several supporting members made, for example, of sheet-metal strips emanate from the ring and fit on the outer sheath of the sleeve-shaped section of the shielding body, with the interposing of an electrical insulation. The entire supporting device is affixed by this means to the shielding body, coaxially to the bushing conductor. The insulation consisting of foil-type strips is adhered to the supporting elements. The connector element designed, for example, as a contact tag is secured to one of the supporting elements. The manufacturing of the described tapping electrode as a metal soldered subassembly is relatively expensive.

The present invention is therefore directed to the problem of developing an electric bushing in which the electric bushing is simplified with respect to its tapping electrode.

SUMMARY OF THE INVENTION

The present invention solves this problem by designing the tapping electrode as an insulating annular member, which is provided with an outer conductive layer and has at least three supporting feet which engage on the shielding body, of which one supporting foot bears the connector element linked to the conductive layer.

An advantageous embodiment of the present invention occurs, in particular, to the retaining and anchoring of the tapping electrode, when the tapping electrode is designed as an insulating annular member, which is provided with an outer conductive layer and has at least three supporting feet which engage on the shielding body, of which one supporting foot bears the connector element linked to the conductive layer and the cross-section of the supporting feet and the inclination of the supporting feet relative to the longitudinal axis of the bushing are adapted to the shielding body in such a way that a press fit of the annular member on the shielding body is able to be achieved.

Another advantageous embodiment of the present invention occurs when on their inner side, the supporting feet have at least one sharp-edged or pointed projection.

Another advantageous embodiment of the present invention occurs when the supporting feet are provided with a circumferentially arranged collar.

Another advantageous embodiment of the present invention occurs when the supporting feet are arranged on a radius that is larger than that of the annular member and that one-piece, more or less radially extending retention arms are provided.

BRIEF DESCRIPTION OF THE INVENTION

DETAILED DESCRIPTION

Figure 1:
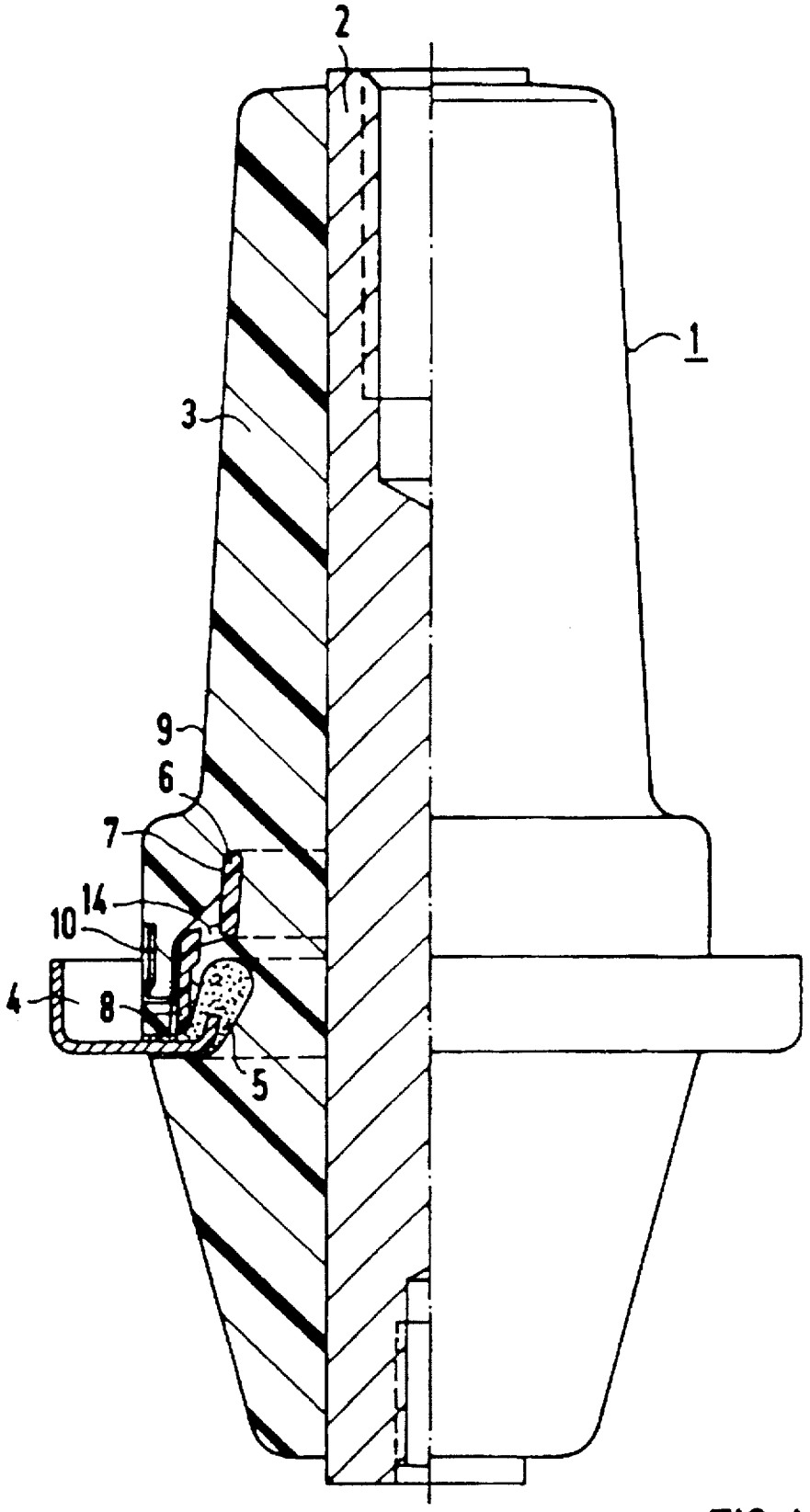
FIG. 1 shows a sketch of an electric bushing comprising an integrally cast electrode for a capacitively coupled voltage-display system.

FIG. 1 depicts an electric bushing, which is assembled from an insulating body, a bushing conductor 2 surrounded by the insulating body 3, an attachment flange 4, a field-controlling shielding body 5, as well as from a capacitively coupled tapping electrode for operating a voltage-display device.

In this case, the shielding body 5 and the attachment flange 4 are unaltered in their design and in their configuration in the bushing 1.

The tapping electrode is designed as an annular member 6 (see FIG. 2) of plastic, which is provided with a conductive layer 7, for example of a conductive lacquer, and has at least three supporting feet 8 that engage on the shielding body 5. One of the supporting feet includes a connector element 10 (which is accessible from the outside the insulating body 3) for coupling to a voltage-display device (as shown, e.g., in FIG. 5).

The supporting feet 8 are adapted to the ring-shaped shielding body 5 with respect to cross-section and inclination relative to the longitudinal axis of the bushing 1 so as to attain a press fit of the annular member 6 on the shielding body 5 in the assembled state, before the insulating body 3 is cast.

Retention arms 14 extend more or less radially outwardly from the annular member 6 and are joined by the supporting feet 8, so that said supporting feet are arranged on a radius that is larger than that of the annular member 6.

Figure 2:
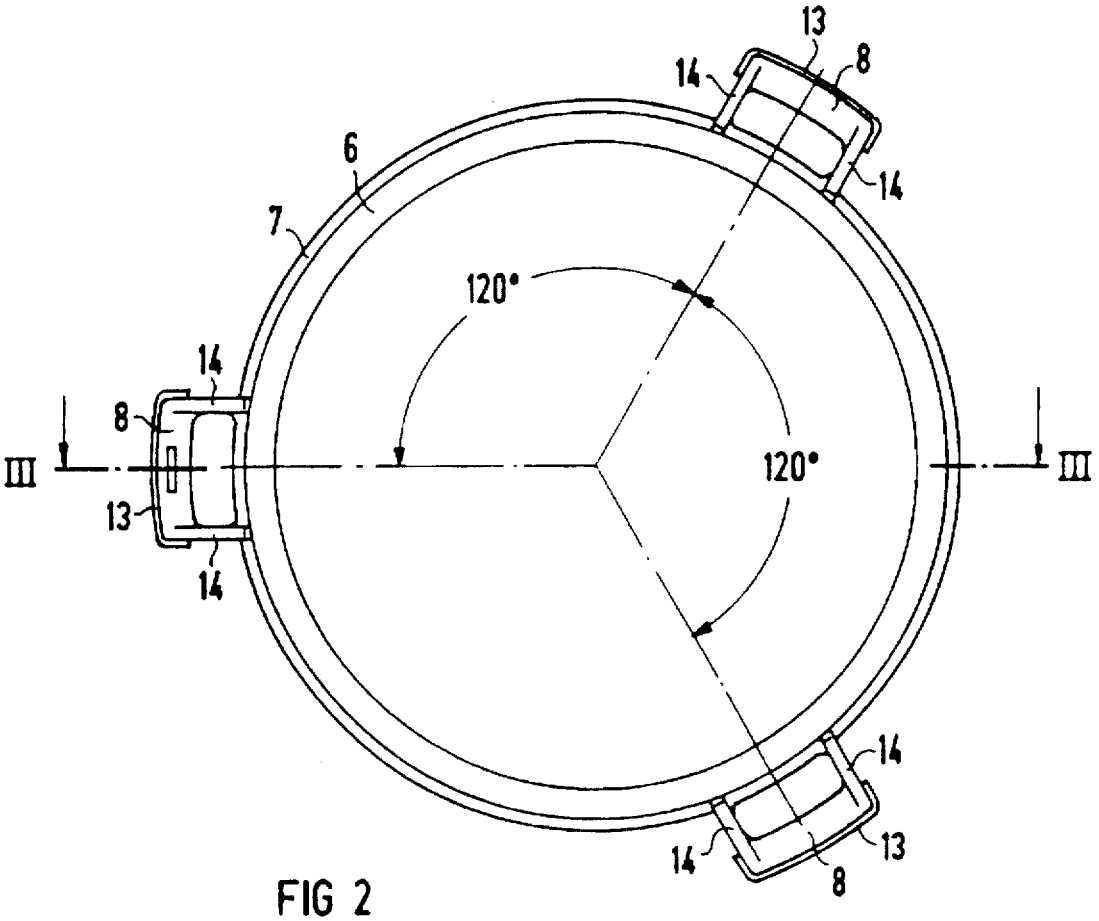
FIG. 2 depicts a tapping electrode designed as an annular member, in a top view.
Figure 3:
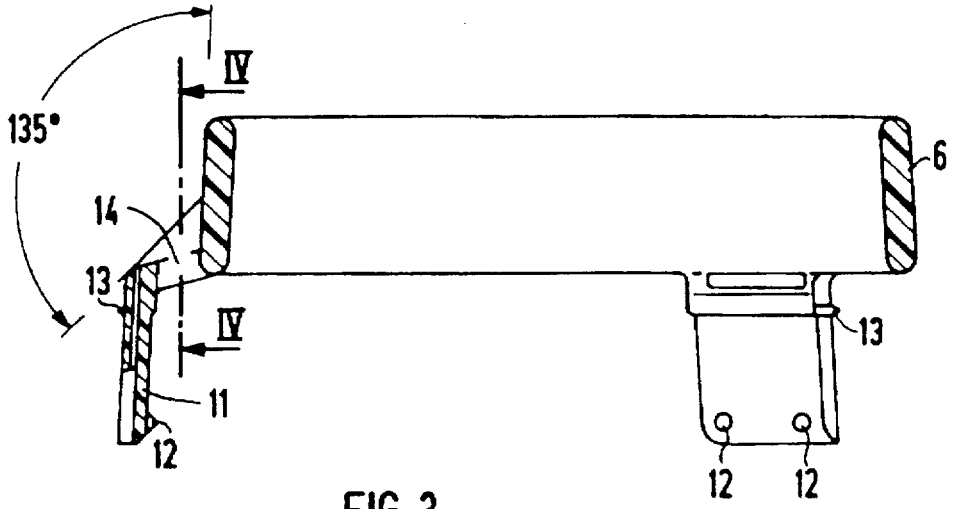
FIG. 3 shows the annular member according to FIG. 2 as a sectional view along the line of intersection III—III.
Figure 4:
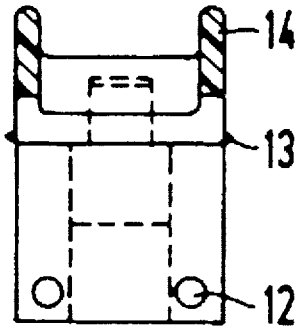
FIG. 4 depicts a section IV—IV according to FIG. 3.

In accordance with FIG. 2, the supporting feet 8 are provided with a circumferentially arranged collar 13. On their inner side 11, the supporting feet have two sharp-edged or pointed projections 12 to anchor them in the shielding body 5 (see FIG. 3). Both measures serve to reliably anchor the shielding electrode 6, 7, 8 in the insulating body 3.

Figure 5:
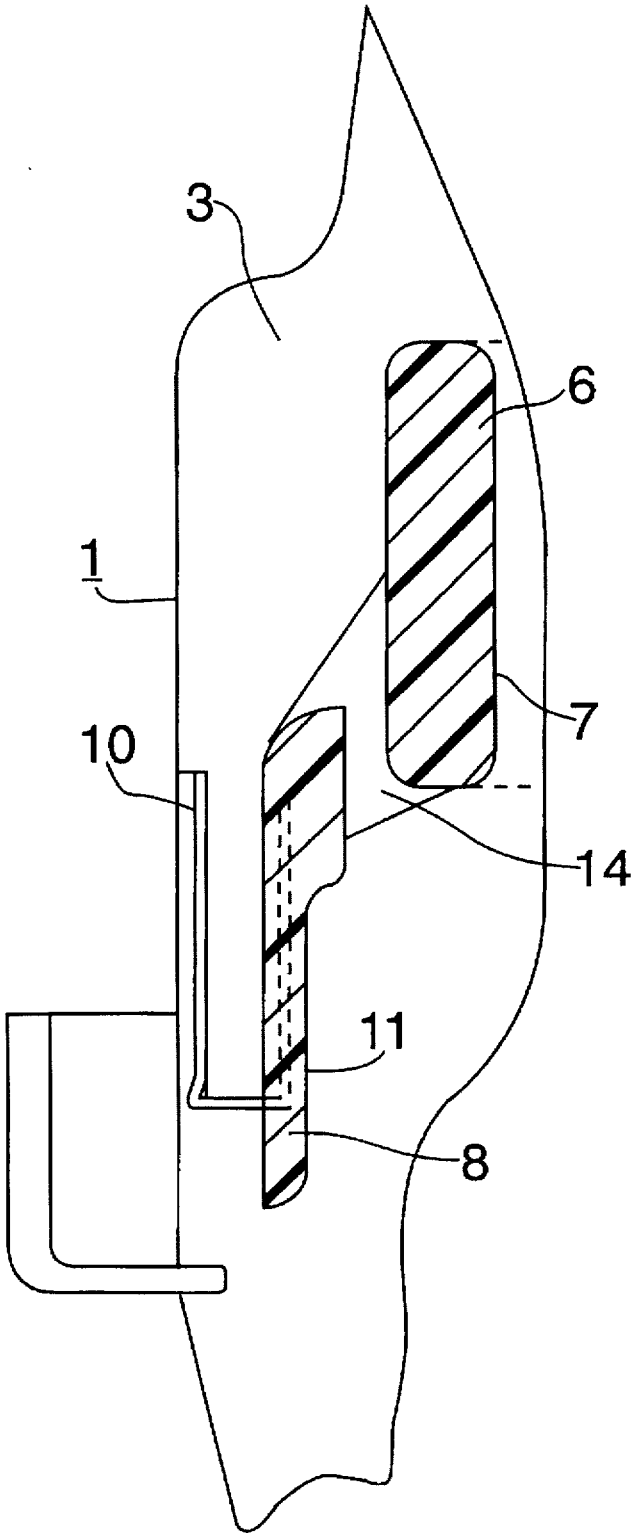
FIG. 5 shows an enlarged view of the electric bushing as illustrated in FIG. 1.

Each of the supporting feet 8 includes an inner side 11. As shown in FIG. 5, the annular member 6, the conductive layer 7 and one of the supporting feet 8 jointly form the tapping electrode for reliable anchoring in the insulating body 3. The tapping electrode includes pointed projections provided on the collars 13 running around the supporting feet 8 and on the inner sides 11 of the supporting feet 8.

What is claimed is:

1. An electric bushing comprising:

a) a bushing conductor;

b) an insulating body surrounding the bushing conductor, and having an inner periphery;

c) an attachment flange anchored in the insulating body;

d) a shielding body arranged on said inner periphery of the insulating body, wherein said shielding body controls an electric field;

e) a capacitive voltage tap provided for coupling to a display device, said voltage tap including:

(i) a tapping electrode concentrically surrounding the bushing conductor and being arranged inside the insulating body; and (ii) a connector element being coupled to said tapping electrode and being accessible from outside the insulating body, wherein the tapping electrode is designed as an insulating annular member, the tapping electrode having an outer conductive layer and at least three supporting feet which engage on the shielding body, wherein one of said supporting feet bears the connector element coupled to the conductive layer.

2. The bushing according to claim 1, wherein a cross-section of the supporting feet and an inclination of the supporting feet relative to a longitudinal axis of the bushing are adapted to the shielding body so that a press fit of the annular member on the shielding body can be achieved.

3. The bushing according to claim 1, wherein each of said supporting feet further comprises an inner side and at least one sharp-edged projection on the inner side.

4. The bushing according to claim 2, wherein each of said supporting feet further comprises an inner side and at least one sharp-edged projection on the inner side.

5. The bushing according to claim 1, wherein each of said supporting feet further comprises an inner side and at least one pointed projection on the inner side.

6. The bushing according to claim 2, wherein each of said supporting feet further comprises an inner side and at least one pointed projection on the inner side.

7. The bushing according to claim 1, wherein each of the supporting feet further comprises a circumferentially arranged collar.

8. The bushing according to claim 2, wherein each of the supporting feet further comprises a circumferentially arranged collar.

9. The bushing according to claim 3, wherein each of the supporting feet further comprises a circumferentially arranged collar.

10. The bushing according to claim 4, wherein each of the supporting feet further comprises a circumferentially arranged collar.

11. The bushing according to claim 5, wherein each of the supporting feet further comprises a circumferentially arranged collar.

12. The bushing according to claim 6, wherein each of the supporting feet further comprises a circumferentially arranged collar.

13. The bushing according to claim 1, further comprising a one-piece substantially radially extending retention arm, wherein each of the supporting feet are arranged on a radius that is larger than that of the annular member.

14. The bushing according to claim 2, further comprising a one-piece substantially radially extending retention arm, wherein each of the supporting feet are arranged on a radius that is larger than that of the annular member.

15. The bushing according to claim 3, further comprising a one-piece substantially radially extending retention arm, wherein each of the supporting feet are arranged on a radius that is larger than that of the annular member.

16. The bushing according to claim 4, further comprising a one-piece substantially radially extending retention arm, wherein each of the supporting feet are arranged on a radius that is larger than that of the annular member.

17. The bushing according to claim 7, further comprising a one-piece substantially radially extending retention arm, wherein each of the supporting feet are arranged on a radius that is larger than that of the annular member.

18. The bushing according to claim 8, further comprising a one-piece substantially radially extending retention arm, wherein each of the supporting feet are arranged on a radius that is larger than that of the annular member.

19. The bushing according to claim 9, further comprising a one-piece substantially radially extending retention arm, wherein each of the supporting feet are arranged on a radius that is larger than that of the annular member.

20. The bushing according to claim 10, further comprising a one-piece substantially radially extending retention arm, wherein each of the supporting feet are arranged on a radius that is larger than that of the annular member.

* * * * *